US011793307B2

(12) United States Patent
Grychta et al.

(10) Patent No.: US 11,793,307 B2
(45) Date of Patent: Oct. 24, 2023

(54) WINE CABINET WITH ELECTRIC POWER FOR EACH SHELF

(71) Applicant: FRIO ENTREPRISE, Arnage (FR)

(72) Inventors: Didier Grychta, Arnage (FR); Nicolas Libeault, Nantes (FR); Hubert Chevalier, Saint Sylvain d'Anjou (FR)

(73) Assignee: Frio Enterprise, Arnage (FR)

( * ) Notice: Subject to any disclaimer, the term of this patent is extended or adjusted under 35 U.S.C. 154(b) by 0 days.

(21) Appl. No.: 17/722,330

(22) Filed: Apr. 16, 2022

(65) Prior Publication Data

US 2022/0330694 A1 Oct. 20, 2022

(30) Foreign Application Priority Data

Apr. 16, 2021 (FR) ..... 21 03944

(51) Int. Cl.
*A47B 73/00* (2006.01)
*A47B 97/00* (2006.01)

(52) U.S. Cl.
CPC ..... *A47B 73/00* (2013.01); *A47B 97/00* (2013.01); *A47B 2097/003* (2013.01); *A47B 2220/0091* (2013.01)

(58) Field of Classification Search
CPC ... A47B 73/00; A47B 97/00; A47B 2097/003; A47B 2220/0091
See application file for complete search history.

(56) References Cited

U.S. PATENT DOCUMENTS 526,309 A * 9/1894 Goerger ..... B65D 85/305 217/19
5,580,155 A * 12/1996 Hildebrand ..... F25D 27/00 439/655
7,097,047 B2 * 8/2006 Lee ..... H05K 7/1491 361/825
7,377,397 B2 * 5/2008 Lee ..... A47B 73/002 211/74

(Continued)

FOREIGN PATENT DOCUMENTS

DE 202014009695 U1 * 3/2015 ..... A47B 55/00
DE 102014108579 A1 * 12/2015 ..... A47B 73/00

(Continued)

*Primary Examiner* — Stanton L Krycinski
(74) *Attorney, Agent, or Firm* — Craft Chu PLLC; Andrew W. Chu

(57) ABSTRACT

A wine cabinet, whose façade is equipped with a door, has an interior volume having shelves. Each shelf is movable between two positions. Each shelf is equipped with reception spaces for a plurality of bottles, electronic detectors of the presence of a bottle and electronic devices of visualization of the presence. The power supply of those electronic detectors and electronic devices of visualization comes from a single centralized supply in the cabinet and supplies two vertical conductors placed inside a wall of the cabinet. Each shelf is electrically connected via a connecting cable flexible connect to vertical conductors. The connection shall be arranged at the level of the shelf on the inner face of the wall, the connecting cable having a sufficient length to ensure the connection when the shelf is deployed. Each shelf is equipped with elastic keeping the cable permanently stretched, whatever the position of the shelf.

8 Claims, 3 Drawing Sheets

(56) References Cited

U.S. PATENT DOCUMENTS

| | | | | |
|---|---|---|---|---|
| 7,588,342 | B2 * | 9/2009 | Buelow | G02B 6/0006 362/125 |
| 7,766,502 | B2 * | 8/2010 | Tress | F21V 33/0012 362/125 |
| 7,784,888 | B2 * | 8/2010 | Oh | F25D 25/025 312/402 |
| 8,833,875 | B2 * | 9/2014 | Arslankiray | A47B 73/00 211/74 |
| 8,861,918 | B2 * | 10/2014 | Vazquez | A47B 97/00 385/135 |
| 9,211,009 | B2 * | 12/2015 | Greenwood | A47B 77/16 |
| 9,414,671 | B1 * | 8/2016 | Smith | A47B 73/00 |
| 9,445,669 | B2 * | 9/2016 | Li | A47B 96/021 |
| 9,585,468 | B2 * | 3/2017 | Udagawa | F16L 3/015 |
| 9,585,474 | B2 * | 3/2017 | Haltmeyer | A47B 88/49 |
| 9,752,822 | B2 * | 9/2017 | Lee | F25D 17/045 |
| 9,844,279 | B2 * | 12/2017 | Cinici | F21V 33/0044 |
| 10,157,316 | B2 * | 12/2018 | Seeley | G06V 20/20 |
| 10,271,643 | B2 * | 4/2019 | Yamamoto | F16L 3/015 |
| 10,278,523 | B2 * | 5/2019 | Ringel | A47B 96/066 |
| 10,542,818 | B2 * | 1/2020 | Keller | A47B 21/02 |
| 10,799,023 | B2 * | 10/2020 | Dinter | A47B 57/04 |
| 11,002,480 | B1 * | 5/2021 | El Sayed | F25D 23/067 |
| 11,112,168 | B2 * | 9/2021 | Carlotto | F25D 27/005 |
| 11,253,071 | B2 * | 2/2022 | Mølgaard | A47B 96/066 |
| 11,428,460 | B2 * | 8/2022 | Yu | A47B 73/00 |
| 11,553,806 | B2 * | 1/2023 | Ryu | G07F 9/105 |
| 2006/0087208 | A1 * | 4/2006 | Oh | F25D 25/025 312/402 |
| 2006/0097611 | A1 * | 5/2006 | Kim | F25D 25/04 62/298 |
| 2007/0228909 | A1 * | 10/2007 | Hwang | F25D 31/007 312/408 |
| 2013/0146552 | A1 * | 6/2013 | Grimes | A47B 88/48 211/126.15 |
| 2014/0126829 | A1 | 5/2014 | Seeley | |
| 2016/0037917 | A1 * | 2/2016 | Li | F25D 25/02 211/186 |
| 2017/0205138 | A1 * | 7/2017 | Hwang | G06Q 10/087 |
| 2019/0257556 | A1 * | 8/2019 | Pinet | A47B 73/00 |
| 2020/0029686 | A1 * | 1/2020 | Dinter | A47F 7/28 |
| 2021/0254890 | A1 * | 8/2021 | Benitsch | F25D 25/021 |
| 2022/0074647 | A1 * | 3/2022 | Yu | A47F 3/0486 |

FOREIGN PATENT DOCUMENTS

| | | | | |
|---|---|---|---|---|
| DE | 102017100959 | A1 * | 7/2018 | |
| DE | 102017119221 | A1 * | 2/2019 | |
| EP | 2549214 | A2 * | 1/2013 | F25D 25/024 |
| EP | 2549215 | A2 * | 1/2013 | F25D 25/02 |
| EP | 3161398 | A1 | 5/2017 | |
| EP | 3161398 | B1 * | 3/2021 | F25D 25/024 |
| FR | 2700913 | A1 | 7/1994 | |
| WO | WO-2016036015 | A1 * | 3/2016 | F25D 25/024 |
| WO | WO-2019085966 | A1 * | 5/2019 | A47B 46/00 |
| WO | 2020141834 | A1 | 7/2020 | |

* cited by examiner

WINE CABINET WITH ELECTRIC POWER FOR EACH SHELF

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to a wine cellar in this case consisting of a cabinet with controlled temperature and humidity provided with bottle storage devices. The bottles, stored in this type of cabinet, are kept in special conditions, allowing optimal preservation of each wine awaiting tasting. They replace and/or improve the cabinets formerly used, and in particular offer much superior conservation control capabilities to the simple living basement rooms that preceded them. These cabinets, which are preferably placed in rooms where they can be protected from light, can also benefit from current technologies for the creation and fine management of an atmosphere favorable to the conservation of bottles. The present invention also relates to a so-called connected cabinet which benefits from a number of technological advances to facilitate its use by its owners.

2. Description of Related Art Including Information Disclosed Under 37 CFR 1.97 and 37 CFR 1.98

In these cabinets, whose front façade is equipped with an access door to the storage space, the bottles are traditionally kept horizontally. To minimize both costs and clutter, it is also planned to store a maximum of bottles in a space forming the bulk of the interior volume of the cabinet. The bottles are arranged in rows in said volume, on superimposed shelves which must offer storage and individualized access to a maximum of bottles. Each shelf is equipped for this purpose with reception slots for a plurality of bottles arranged side to side. This storage by superimposed shelves makes it possible to ensure, on the one hand, the horizontal position of the bottles, and, on the other hand, an air circulation allowing a homogeneous distribution of the temperature and humidity.

This requirement to optimize the number of bottles stored must obviously not preclude the need for easy and individual access to each bottle to be extracted, and the shelves are therefore provided for sliding. Each shelf is therefore movable between two positions respectively deployed outside the rack, allowing the extraction of the selected bottle, and retracted into the volume of the latter.

BRIEF SUMMARY OF THE INVENTION

The wine cabinet of the invention being equipped with electronic means of signaling and detection of individual locations indicating those occupied by a bottle and those that are empty, each shelf must therefore be electrically powered in order to operate the components necessary for said advanced signaling and detection functions. The power supply to the wine cabinet comes from a single main connection, arriving at a predetermined place in the cabinet, whose electrical characteristics (current, voltage, etc.) are then transformed to be able to provide the strong signals necessary for the operation of the various components of each shelf. In this respect, sliding the shelves raise the problem of the mobility of the unit to be supplied, which must not be to the detriment of the quality of connection.

It is certainly possible to use flexible conductive cables carrying electrical energy to each shelf from a centralized connection, using an "octopus" type assembly, but this solution has many disadvantages. Providing a cable per shelf means that there will be a number of cables of different lengths in the interior volume of the cabinet, which is unsightly and expensive if all the lengths are considered. The presence of these cables can also be problematic because their proliferation is likely to impede the movement of the shelves. Organization in beams to avoid a disorderly presence in the volume of the cabinet generally leads to less flexibility, with the risk of making it more difficult for the user to handle the shelves, especially when they are pushed back into the interior space. In addition, in the environment of a wine cabinet, the installation of an electrical cable harness near the evaporator of the refrigeration circuit imposes constraints.

Finally, if they remain individualized, and they hang in the interior space in the vicinity of the shelves, the cables are potentially more prone to untimely disconnections or tearing. It should be noted that the connection cables of the distal shelves of the power supply, which have the longest length, concentrate a little all the disadvantages mentioned above. The risks of entanglement of cables with shelves, or attachment with bottles or other obstacles, although always present, are obviously greater for longer cables.

The invention remedies these multiple limitations and problems by providing an optimized power solution including uniform wiring, regardless of the location of the shelf in the cabinet constituting the wine cabinet. This solution also optimizes the uniform length of the connection cables and makes it possible to control their positioning very precisely in relation to the shelf they supply, regardless of the positioning of the shelf in relation to the cabinet. Finally, the power cables are no longer visible to the user, they are managed by the system in such a way as to be somehow "stored" at all times, regardless of the movements of the shelf.

Thus, according to the invention, the power supply of said electronic means of detection and said electronic means of visualization comes from a single centralized power supply in the cabinet and feeding two vertical conductors placed inside a wall of the cabinet, each shelf being electrically connected via a bending connection cable to means of connection of said cable to the conductors vertical, these means of connection being arranged at the level of the shelf on the inner face of said wall. In addition, the said flexible connecting cable has a sufficient length to ensure the connection when the shelf is deployed, and each shelf is equipped with elastic means capable of keeping the cable stretched at all times, regardless of the position of the shelf.

In other words, the solution proposed by the invention manages the movement of identical connecting bending cables, said management being carried out so that they are continuously and permanently under control, regardless of the displacements printed to said shelves. These individual connecting cables are, because of the double distribution of the power supply first of vertical speed then of horizontal speed, of minimum length and calibrated to supply only one shelf, the one which is located at the level of the means of connection of the cable to the vertical distribution of the power supply. These means of connection are in practice distributed along one of the side walls of the cabinet.

Depending on one possibility, elastic means may consist of an elongated elastic tensioner having an end loop through which the connecting cable passes, dividing the latter angularly into a first section from the means of connection to the end loop of the tensioner and a second section from the said end loop to an attachment point of the flexible cable to the shelf, the two sections together forming a length of cable to maintain the connection when the shelf is deployed, the tensioner being attached to the shelf at its end opposite to the loop.

The tensioner grows elastically when the shelf is deployed, because the connecting cable exerts traction at the end loop as the angle formed by the sections of the flexible cable becomes more obtuse. When the shelf is completely closed, this angle is, on the contrary, very acute, the two sections becoming almost parallel and one of them being noticeably in contact with the shelf. These sections, because the means of connection are located at the level of the shelf, and the tensioner is attached to the said shelf, are in practice located in the volume covered by the displacement of the shelf, more precisely in the volume between the lower and upper planes surrounding the horizontal shelf.

Preferably, the means of connecting the flexible cable to the vertical conductors are placed in the vicinity of a corner edge of the cabinet separating the bottom wall of the cabinet located opposite the door and a side wall, at the level of the vertical conductors, and the tensioner is fixed on the rear cross member of the shelf located next to said bottom wall, in the vicinity of the opposite corner edge.

In this case, the connecting cable becomes invisible when the shelf is retracted, since it does not hang because of the elastic tension provided by the tensioner and because it is located in the horizontal volumetric imprint of the shelf when it moves, and in the back part of it.

Preferably still, vertical conductors are conductive bars placed inside a side wall of the cabinet. This conductivity supply in metal bars molded into the wall makes it possible to considerably simplify the electrical distribution to the shelves. Each shelf thus benefits from a power supply for example of 5V and 3A continuous, adapted to the electronics that reside in each shelf, which will be mentioned in more detail in the following.

At one end of the connecting cable, the means of connecting the cable to the vertical bars consist, for example, of conductive screws passing through eyelets equipping the end of conductors emerging from a sheath at a first free end of the flexible cable, said conductive screws passing through the wall of the cabinet in the direction of the conductive bars with threaded orifices, bars in which they are screwed.

According to a possible configuration of the invention, the means of connection of the flexible connection cable may comprise a cover of insulating material covering the eyelets and provided with a fixing system of the end of the flexible connection cable, said cover being fixed to the inner face of the wall by means of the conductive screws.

The flexible cable is therefore subject to the insulating cover, which avoids any untimely traction at the level of the eyelets making the electrical connection. The solution used allows the mechanical attachment of the cover and eyelets via a conductive component which therefore performs a second electrical connection function. Depending on a possible configuration, the system for fixing the flexible connection cable to the insulating cover consists of inner reliefs of the cover comprising a caliper constituting an elastic attachment clip of a first over-molded ring on the outside of the flexible cable sheath surrounding the constituent wires of the said cable.

The flexible connection cable is also secured to the shelf by means of attachment placed at the level of the cross member supporting the tensioner. These means of attachment to the shelf may for example consist of a clip attached to the shelf and able to elastically clip a second over-molded ring equipping the sheath of the flexible connection cable. Here again, the objective is to avoid changing the organization of the cable's solidarization to the shelf, which is important in the mechanical logic implemented to ensure the permanent tension of the cable.

In fact, the flexible connection cable may only connect the power supply of the wine cabinet to the back of each shelf and may not support the power supply of the electronic functions provided on the shelf. In this case, it must have a length a little longer than the distance separating the deployed shelf from the power bars. According to the invention, the cable can then be equipped with a connector located at a second free end and near the second over-molded ring, cooperating with a connector attached to the shelf in the vicinity of the clip.

Other purposes and advantages of the present invention will appear during the description that follows relating to an embodiment which is given only as an indicative and non-limiting example.

BRIEF DESCRIPTION OF THE SEVERAL VIEWS OF THE DRAWINGS

The understanding of this description will be facilitated in particular by referring to the drawings attached in the annex.

DETAILED DESCRIPTION OF THE INVENTION

Figure 1:
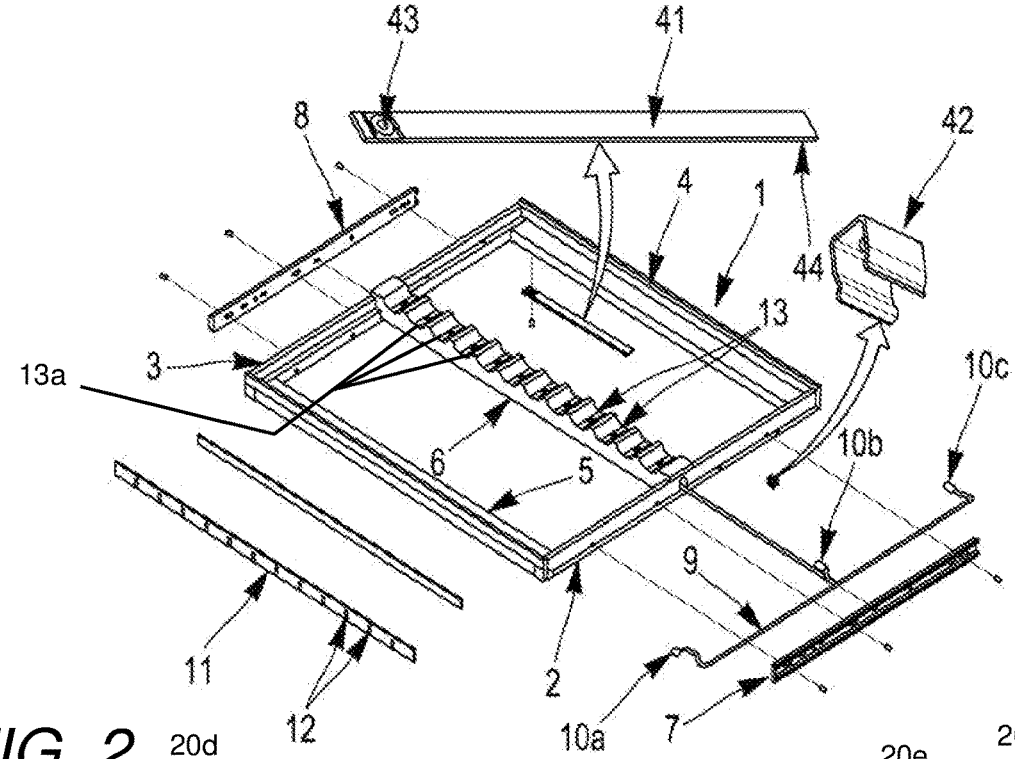
FIG. 1 represents an exploded perspective view of a shelf according to the invention, whose components for managing the voltage of the flexible connection cable are shown enlarged.

With reference to FIG. 1, shelf 1 very generally has two beams 2, 3 (a first side beam 2, a second side beam 3), two sleepers 4, 5 (a rear cross beam 4, a front cross beam 5) and a central bar 6 conformed to house bottles. The beams 2, 3 are equipped with rails 7, 8 which are screwed into them and allow their sliding in slides equipping the side walls of the cabinet of the wine cellar (not shown). The spars 2 also includes an internal connection cable 9 equipped with three connectors 10*a*, 10*b* and 10*c* (power supply connection means 9, 10*a*, 10*b*, 10*c*, 30) to distribute direct electrical voltage and current to internal circuits providing the electronic functions mentioned in the paragraph. These voltage/current signals are supplied to shelf 1 by the cabinet power supply via the flexible connection cable 20 shown in FIG. 2.

Connector 10*a* thus makes it possible to supply, by connection to a printed circuit board which manages it, a bar 11 of light-emitting diodes 12 which signal the presence of cylinders (such as wine bottles, each wine bottle having a body and a neck) in the conformed locations in the central bar 6. This bar 11 of diodes 12 equips the cross 5 located at the front of the shelf 1, the one which is therefore located near the door of the cabinet (wine cabinet 1*a*, having a façade 1*b* with a door 1*c* and an interior volume 1*d*) and is visible to the users. The 10*b* connector also powers a printed circuit board placed in the central bar 6 and which manages 13 detectors of the presence of the bottles. The third connector 10*c* allows the connection to a connector 21 of the flexible cable 20 of FIG. 2. It is through him that the connection to the centralized supply of the wine cabinet of the invention is made.

The cross member 4, which is therefore the rear cross member of the shelf, therefore placed next to the bottom wall of the cabinet and distal of the door, has two specific components that allow the management of the flexible cable of connection 20 compared to the shelf 1 and which are enlarged in relation to the scale of the rest of FIG. 1: the tensioner 41 and a fixing clip 42 of the flexible cable 20 of connection.

Figure 3:
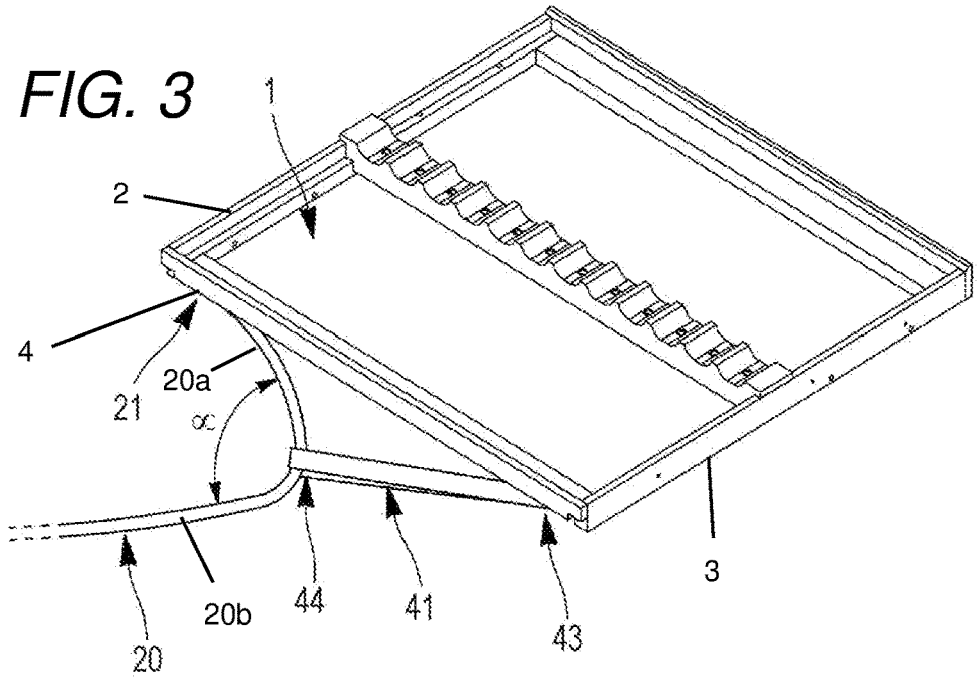
FIG. 3 illustrates a perspective view of the operation of the voltage management of the flexible connection cable.

Tensioner 41 is attached to the vicinity of one end of cross member 4 via a screw through a 43 eyelet. Clip 42 is also fixed via a screw, in the vicinity of the other end of the crossmember 4. The two attachment points are preferably located on the same face of the crossmember 4. The tensioner 41 is actually an elastic band whose free ends are fixed to each other at the level of the eyelet 43. The end of the tensioner 41 which does not have the eyelet 43 has an end loop 44 in which the flexible cable 20 is slipped, as shown in FIG. 3. It is at this loop 44 that the recall force exerted by the elastic tensioner 41 on cable 20 is carried out. The characteristics of this tensioner 41 can for example be the following: it can be composed of 50% polyester and 50% latex.

The sheath of the flexible cable 20 of connection presents, in the vicinity of its end connector 21, an over-molding in the form of ring 22 intended to clip elastically in the clip 42 when the connectors 21 and 10*c* are connected. This clipping secures the flexible cable 20 to the cross member 4 of the shelf 1, at the location chosen for the proper functioning of the mechanical system, and it also prevents any tearing likely to damage the connector 21, or even the connector 10*c*. In the representation of FIG. 3, the connection and clipping of the over-molded ring 22 on the sheath of cable 20 in the clip 42 is on a lower face of the cross member 4 not visible in the figure, which illustrates a perspective seen from the top of the shelf 1. Similarly, the attachment of the tensioner 41, via the eyelet 43, to the other end of said crossbeam 4 is not visible either.

Figure 2:
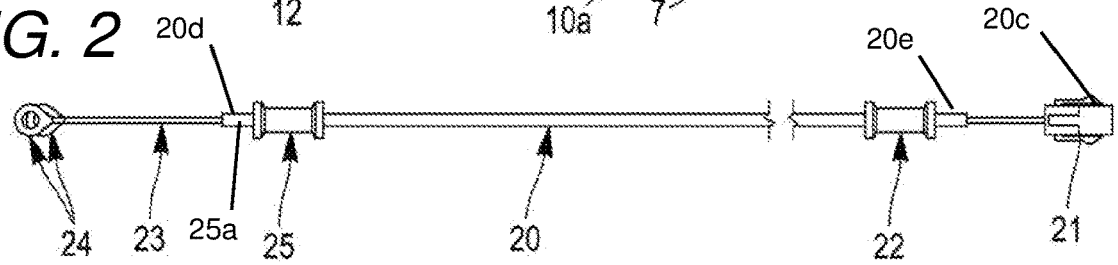
FIG. 2 shows an elevated schematic view of such a flexible patch cable.
Figure 4:
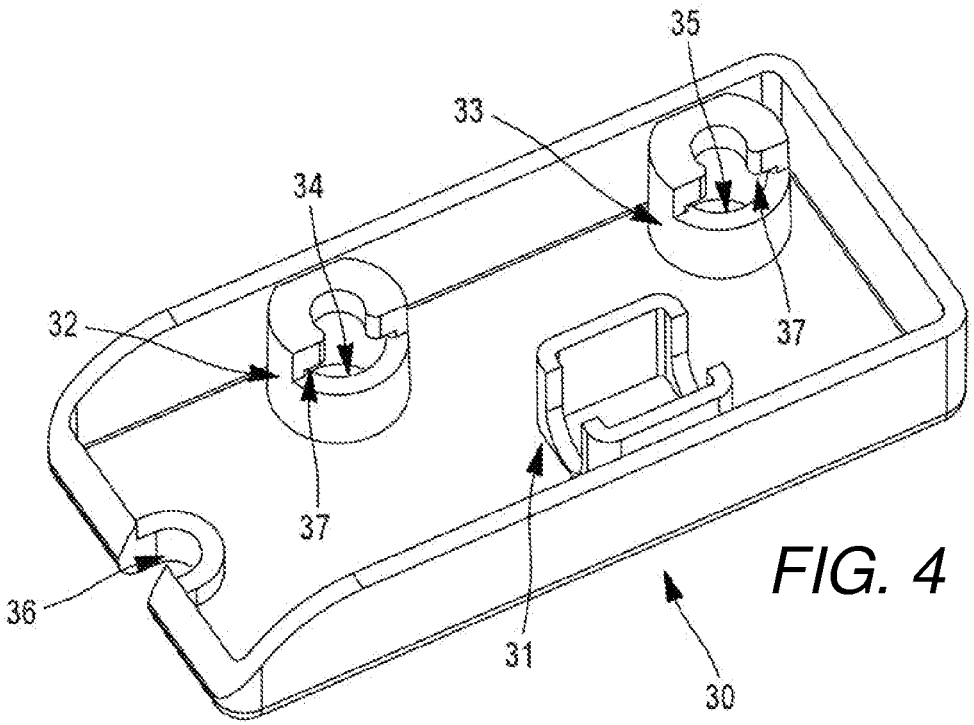
FIG. 4 represents a perspective view of the inside of the insulating material cover.

As shown in FIG. 2, at the other end of the connecting cable 20, the sheath stops to let out individualized conductors 23 to which connection eyelets 24 are welded. These allow a fixing by screwing of the corresponding end of the flexible cable 20 to the electricity distribution bars equipping as mentioned a wall for example side of the cabinet. This attachment is done via an insulating cover 30 (see FIG. 4) itself fixed to said wall by the same screws, and whose inner face has reliefs defining a clip of solidarization of a second over-molded ring 25 equipping the other free end of the flexible cable 20, thus preventing traction or any untimely stress from damaging the flexible cable 20 or cut the electrical connection.

More precisely, the insulating cover 30 comprises, inside the volume it delimits, a stirrup 31 in which the over-molded ring 25 is clipped, which is therefore firmly attached to it. A notch 36 practiced in one of the edges of the cover 30 allows the passage of the cable 20, upstream of said ring 25, so as not to hinder the fixing of the cover 30 in contact with the wall of the cabinet. The cover 30 also has two cover holes 34, 35 for the passage of the conductive screws of attachment to said wall, orifices which are surrounded by truncated barrels 32, 33 of guidance, a portion of the peripheral wall of the inner end of the barrels 32, 33 being missing. The absence of a wall at this point makes it possible to insert the eyelets 24 into the barrels 32, 33, perpendicular to their axis, so that they can be positioned substantially coaxial to the said barrels 32, 33, that is to say also coaxial to the fixing screws. A slot 37 is also provided for this purpose, of thickness of the same order as that of the connection eyelet 24, so that when inserted into it, it cannot move from the position centered in the barrel 32, 33. Contact with the screw that passes through it is therefore ensured.

Figure 5:
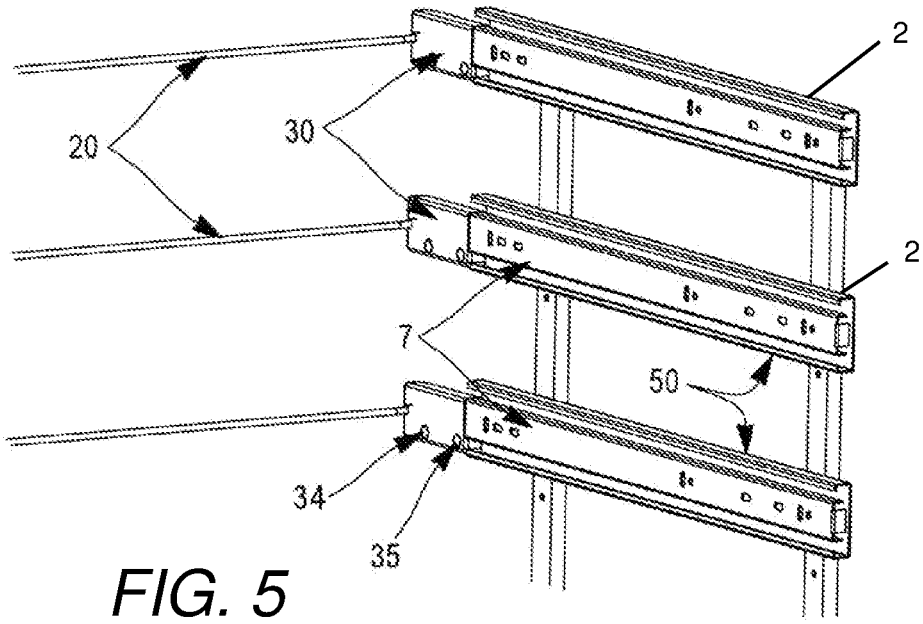
FIG. 5 shows a perspective view of a part of the side wall on which the covers are in the rear extension of the sliding slides of the shelves.
Figure 6:
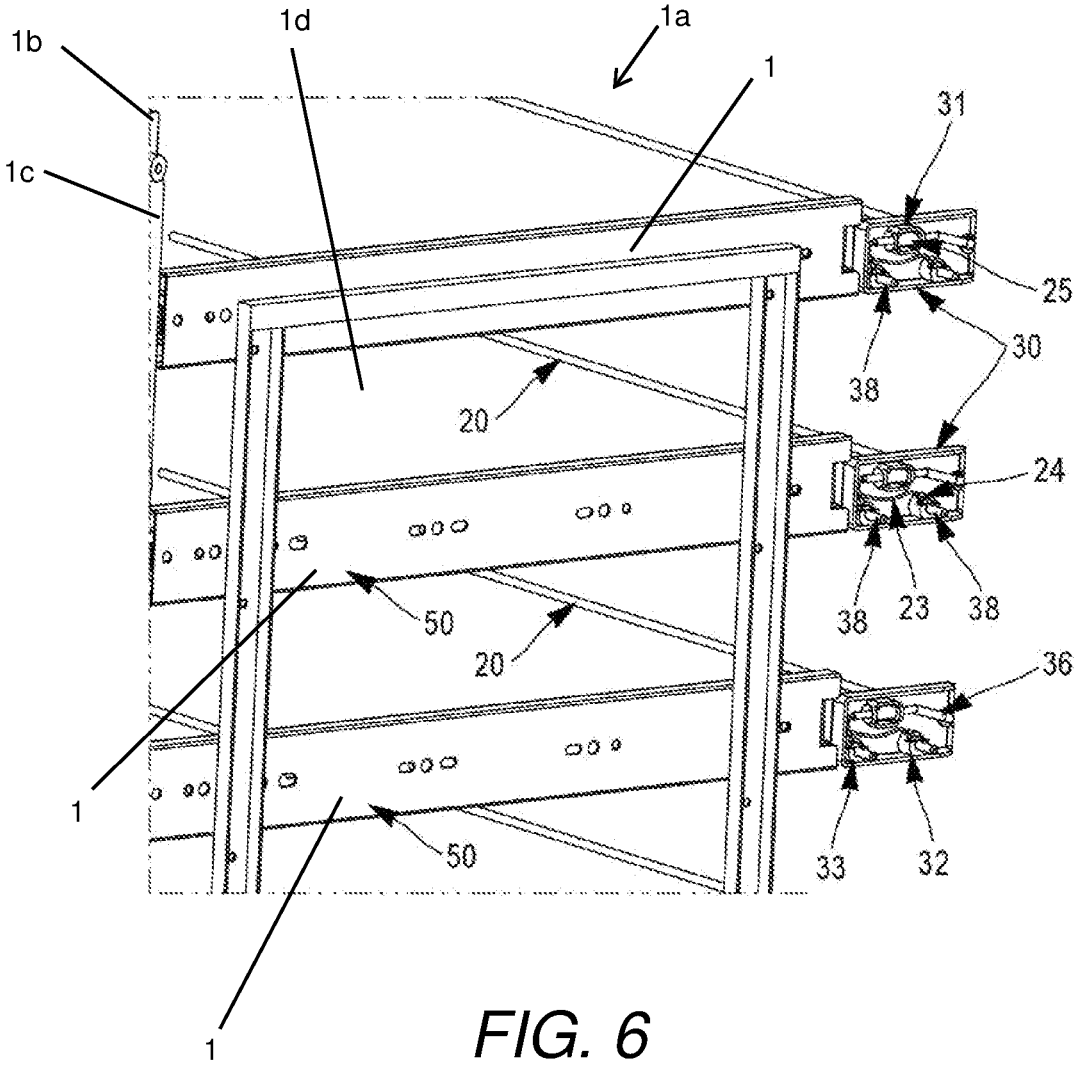
FIG. 6 shows the same perspective view, on the opposite side, i.e. from the side wall.

FIGS. 5 and 6 show where and how these 30 covers are installed in the wine cabinet 1*a* of the invention. Thus, they are positioned in the extension of the slides of the shelves 1, that is to say in the suite of rails 7 mounted sliding in slides 50 attached to the side walls. The covers 30 are in the present case placed at the back of those slides, in the vicinity of the corner edge between the side wall and the back wall of the cabinet, opposite the front door. FIG. 5 shows more particularly the location of the orifices (cover holes) 34, 35 of insertion of the conductive screws 38 of fixing (see FIG. 6) conductive of the covers 30 to the wall.

As shown in FIG. 6, the end part of the flexible cable 20 that is housed in the cover 30 enters the inner volume of said cover 30 via the notch of circular appearance 36. The over-molded ring 25 of the sheath of the flexible cable 20 is clipped into the caliper 31, so that any risk of tearing is eliminated. The connection eyelets 24 ending the conductors 23 are inserted into the slots 37 (see FIG. 4) and therefore centered in the barrels 32, 33 guide conductive screws 38 conductors of attachment to the vertical supply bars.

The operation, easy to understand with reference to FIG. 3, is as follows: when shelf 1 is pulled outwards, the flexible cable 20 tightens and the value of angle a (first section 20*a*, second section 20*b*) increases, as well as the length of tensioner 41 in the direction of displacement of shelf 1. Cable 20 is therefore provided for a total length to take out the shelf 1 to its output stop, that is to say fully deployed. As soon as shelf 1 is retracted into the volume of the cabinet, tensioner 41 exerts a recall force on the elbow of the flexible cable 20 of connection, the angle a decreases and the section of said cable 20 located between the tensioner 41 and the cross member 4 is driven towards said crosspiece. In the fully retracted position of shelf 1, the two sections of cable 20 on either side of loop 44 of tensioner 41 are practically parallel, almost in contact with the rear crossbeam 4, and completely invisible to the user.

The solution makes it possible to guarantee an optimal functioning of the power management of the plurality of shelves 1 superimposed, without hindering their movement.

The example given above with reference to the annexed figures is not exhaustive or limiting of the invention, which includes in particular the shape variants for the tensioner 41, the clip 42, as well as variants of composition of the tensioner 41, etc.

We claim:

1. A wine cabinet, comprising:

a façade being equipped with a door;

an interior volume being accessible through said door;

a plurality of shelves in said interior volume, the shelves being slidingly superimposed to each other, wherein each shelf of said plurality of shelves is movable between a deployed position out of said interior volume and a retracted position in said interior volume, wherein each shelf of said plurality of shelves is comprised of:

a first side beam;

a second side beam opposite said first side beam;

a front cross beam between said first side beam and said second side beam;

a rear cross beam between said first side beam and said second side beam and across from said front cross beam;

a central bar extending from said first side beam to said second side beam, wherein said central bar is comprised of a plurality of reception spaces and an electronic means of detecting presence in a respective reception space of said plurality of reception spaces; and electronic means of viewing occupation of each shelf of said plurality of shelves on said front cross beam, wherein the electronic means of detecting presence is positioned in said respective reception space so as to detect a neck of a bottle in said respective reception space, and wherein the electronic means of viewing occupation is positioned in said shelf so as to view a body of the bottle in the shelf;

a power supply connection means for the electronic means of detecting presence and the electronic means of viewing occupation; and a plurality of connection cables being electrically connected to said plurality of shelves so as to ensure connection of each shelf of said plurality of shelves to two vertical conductors of a central wine cabinet power supply in said deployed position and in said retracted position, wherein each shelf of said plurality of shelves is further comprised of elastic means for stretching a respective connection cable of said plurality of connection cables in said deployed position and in said retracted position, wherein the elastic means of stretching comprises:

an elongated tensioner having an end loop, said respective connecting cable of said plurality of connection cables passing through said end loop so as to angularly divide said respective connecting cable into a first section and a second section so as to power a respective shelf of said plurality of shelves through said power supply connection means in said deployed position and in said retracted position, said first section extending from said end loop to a point of attachment to said power supply connection means on said respective shelf of said plurality of shelves, said second section extending from said end loop opposite said first section.

2. The wine cabinet, according to claim 1, wherein said power supply connection means is placed on said rear cross beam and said first side beam, and wherein said elongated tensioner is fixed on said rear cross beam and said second side beam.

3. A wine cabinet, comprising:

a façade being equipped with a door;

an interior volume being accessible through said door;

a plurality of shelves in said interior volume, the shelves being slidingly superimposed to each other, wherein each shelf of said plurality of shelves is movable between a deployed position out of said interior volume and a retracted position in said interior volume, wherein each shelf of said plurality of shelves is comprised of:

a first side beam;

a second side beam opposite said first side beam;

a front cross beam between said first side beam and said second side beam;

a rear cross beam between said first side beam and said second side beam and across from said front cross beam;

a central bar extending from said first side beam to said second side beam, wherein said central bar is comprised of a plurality of reception spaces and an electronic means of detecting presence in a respective reception space of said plurality of reception spaces; and electronic means of viewing occupation of each shelf of said plurality of shelves on said front cross beam, wherein the electronic means of detecting presence is positioned in said respective reception space so as to detect a neck of a bottle in said respective reception space, and wherein the electronic means of viewing occupation is positioned in said shelf so as to view a body of the bottle in the shelf;

a power supply connection means for the electronic means of detecting presence and the electronic means of viewing occupation; and a plurality of connection cables being electrically connected to said plurality of shelves so as to ensure connection of each shelf of said plurality of shelves to two vertical conductors of a central wine cabinet power supply in said deployed position and in said retracted position, wherein each shelf of said plurality of shelves is further comprised of elastic means for stretching a respective connection cable of said plurality of connection cables in said deployed position and in said retracted position, wherein said power supply connection means comprises a cover having cover holes, and conductive screws passing through said cover holes, wherein each connection cable of said plurality of connection cables is comprised of a sheath, a conductor extending from said sheath, and connection eyelets at an end of said conductor, said conductor emerging from said sheath at a first free end, and wherein said connection eyelets and said conductor pass through said cover so as contact said conductive screws for connection to said two vertical conductors of the central wine cabinet power supply.

4. The wine cabinet, according to claim 3, wherein said cover is comprised of insulating material covering said cover holes, each connection cable of said plurality of connection cables being connected to respective conductive screws.

5. The wine cabinet, according to claim 4, wherein said cover further comprises a stirrup, wherein each connection cable of said plurality of connection cables is further comprised of a first ring molded over said sheath at said first free end, and wherein said first ring is elastically clipped into said stirrup.

6. A wine cabinet, comprising:

a façade being equipped with a door;

an interior volume being accessible through said door;

a plurality of shelves in said interior volume, the shelves being slidingly superimposed to each other, wherein each shelf of said plurality of shelves is movable between a deployed position out of said interior volume and a retracted position in said interior volume, wherein each shelf of said plurality of shelves is comprised of:

a first side beam;

a second side beam opposite said first side beam;

a front cross beam between said first side beam and said second side beam;

a rear cross beam between said first side beam and said second side beam and across from said front cross beam;

a central bar extending from said first side beam to said second side beam, wherein said central bar is comprised of a plurality of reception spaces and an electronic means of detecting presence in a respective reception space of said plurality of reception spaces; and electronic means of viewing occupation of each shelf of said plurality of shelves on said front cross beam, wherein the electronic means of detecting presence is positioned in said respective reception space so as to detect a neck of a bottle in said respective reception space, and wherein the electronic means of viewing opposition is positioned in said shelf so as to view a body of the bottle in the shelf;

a power supply connection means for the electronic means of detecting presence and the electronic means of viewing; and a plurality of connection cables being electrically connected to said plurality of shelves so as to ensure connection of each shelf of said plurality of shelves to two vertical conductors of a central wine cabinet power supply in said deployed position and in said retracted position, wherein each shelf of said plurality of shelves is further comprised of elastic means for stretching a respective connection cable of said plurality of connection cables in said deployed position and in said retracted position, wherein each shelf of said plurality of shelves further comprises a means of attachment of a respective connection cable of said plurality of connection cable to a corresponding shelf of said plurality of shelves on said rear cross beam so as to support the elastic means.

7. The wine cabinet, according to claim 6, wherein the means of attachment comprises a clip fixed to said rear cross beam, wherein each connection cable of said plurality of connection cables is comprised of a sheath and a second ring molded over said sheath, and wherein said second ring is elastically clipped in said clip.

8. The wine cabinet, according to claim 7, wherein each connection cable of said plurality of connection cables is further comprised of a connector located at a second free end, said second ring being between said sheath and said connector, so as to connect to said power supply connection means at said clip.

* * * * *